United States Patent [19]

Rousseau

[11] Patent Number: 4,903,900

[45] Date of Patent: Feb. 27, 1990

[54] METHOD AND APPARATUS FOR SHREDDING PAPER OR THE LIKE

[76] Inventor: David Rousseau, 2372 Palermo Dr., San Diego, Calif. 92126

[21] Appl. No.: 309,681

[22] Filed: Feb. 10, 1989

[51] Int. Cl.[4] ..... B02C 18/16

[52] U.S. Cl. ..... 241/30; 241/167; 241/222; 241/235; 241/242

[58] Field of Search ..... 241/100, 236, 235, 242, 241/243, 135, 143, 166, 167, 223, 224, 225, 222, 30

[56] References Cited

U.S. PATENT DOCUMENTS

| | | | |
|---|---|---|---|
| 3,346,197 | 10/1967 | Sagar | 241/235 X |
| 3,545,689 | 12/1970 | Luscombe | 241/243 X |
| 4,200,239 | 4/1980 | Simone et al. | 241/243 X |
| 4,773,603 | 9/1988 | Schwelling | 241/167 |
| 4,817,877 | 4/1989 | Itoh et al. | 241/225 X |

FOREIGN PATENT DOCUMENTS

| | | | |
|---|---|---|---|
| 2045280 | 1/1980 | Fed. Rep. of Germany | 241/243 |

*Primary Examiner*—Mark Rosenbaum

*Attorney, Agent, or Firm*—Bernard L. Kleinke; William Patrick Waters; Jerry R. Potts

[57] ABSTRACT

A paper shredder for accommodating paper of varying stacks of thickness bound together with staples and the like. A pair of low speed feed rollers are disposed within the device for engaging the paper and for moving the paper into a contoured throat which guides the paper into a primary brush assembly having a set of wire bristles that are rotating at a very high rate of speed. As the paper makes contact with the wire bristles, the paper is pulled along the throat, and simultaneously shredded as it is pulled into the shredding chamber. A stationary wire brush assembly is mounted within the shredding chamber includes a set of long wire bristles that permits the bristles of the two brush assemblies to mesh so that as the bristles of the primary brush assembly are rotated they mesh with the bristles of the stationary brush assembly thereby discharging the shredded paper bits, staples, paper clips and other objects that become lodged in the primary brush bristles the shredding chamber.

18 Claims, 2 Drawing Sheets

FIG. 1
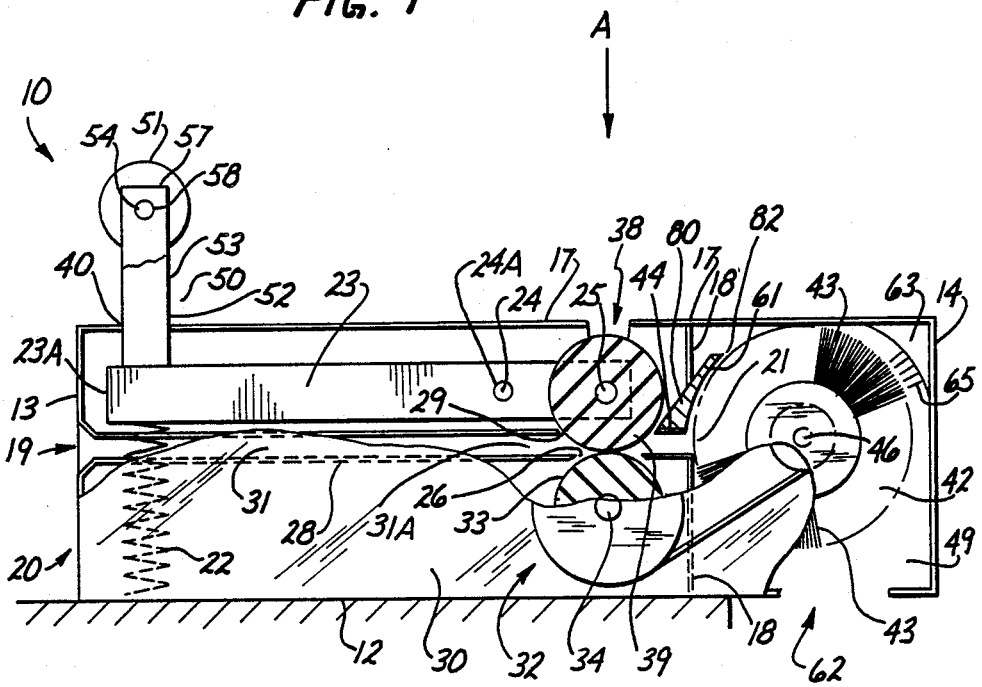
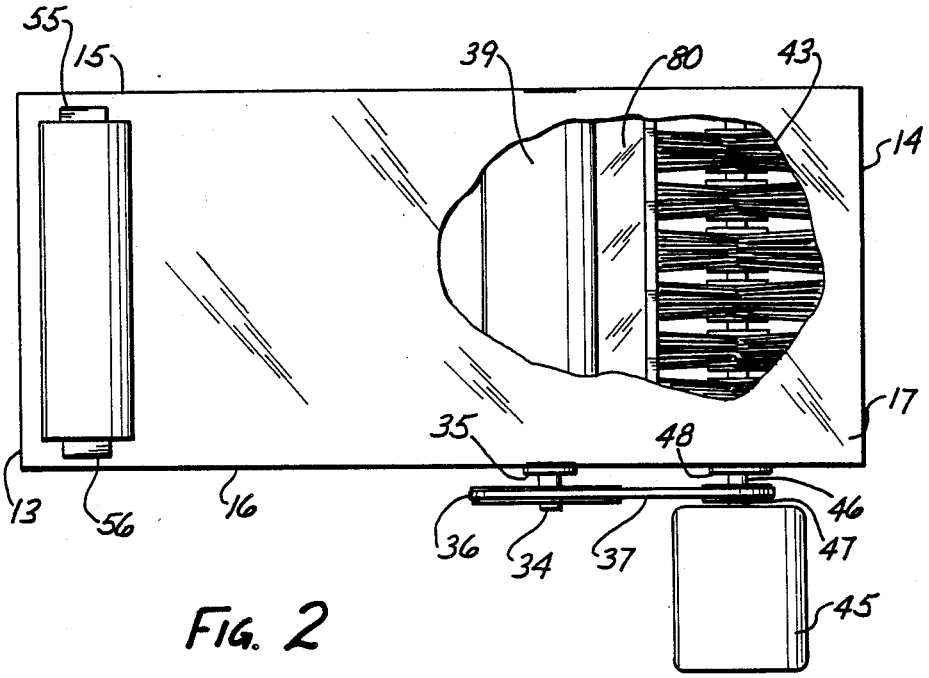
FIG. 2

METHOD AND APPARATUS FOR SHREDDING PAPER OR THE LIKE

DESCRIPTION

1. Technical Field

This invention relates in general to shredders, and more particularly to shredders for shredding paper and other paper-like objects.

2. Background Art

Paper shredders of various types and kinds have been known in the art. For example, reference may be made to the following U.S. Pat. Nos.: 1,002,799; 3,630,460; and 3,797,765.

Typically such devices include rollers with external threads or discs which are intermeshed or closely aligned so as to shred, tear or cut paper objects as they are fed between such threads or discs. Such devices however have been less than desirable because when used they have experienced jamming or failure problems when certain foreign objects other than paper are introduced between the threads or discs. In this regard, for example, when a heavy duty staple or paper clip is accidentally introduced into such shredders the staple or paper clip may become jammed or wedged between the threads or discs or the foreign object may even cause the threads or discs to be fractured or broken. Therefore, it is frequently necessary to disassemble such devices to either remove the foreign object to correct the jammed device or to replace the broken threads or discs when they are fractured or broken.

Therefore, it would be highly desirable to have a new and improved paper shredder for mutilating paper or the like that would not be susceptible to easy jamming or breakage due to staples, paper clips or other foreign objects being accidentally lodged in the paper shredder.

Such prior known shredding apparatus have also been limited in that they had difficulty in shredding material which is excessively thick. Such apparatus have therefore required special thread mounting to accommodate stacks of paper of varying degrees of thickness.

While such apparatus have been successful in some applications the special mounting arrangements have increased the manufacturing cost by adding additional moving parts. In addition, by being more complex, skilled technicians are required to perform the more complex maintenance techniques associated with such apparatus.

Therefore, it would be highly desirable to have a new and improved paper shredder, which could accommodate stacks of paper of varying degrees of thickness, without requiring special thread mountings and the like. Moreover, such a device should be relatively inexpensive to manufacture, highly efficient, cost effective, and easily maintained by a novice or inexperienced operator.

DISCLOSURE OF INVENTION

Therefore, it is the principle object of the present invention to provide a new and improved paper shredder, which would not be susceptible to easy jamming or breakage due to staples, paper clips and other foreign objects attached to the paper being shredded.

A further object of the present invention is to provide such a new and improved paper shredder, which is able to accommodate and shred stacks of papers of varying degrees of thickness, without tending to jam.

Another object of the present invention is to provide such a new and improved paper shredder, which is highly efficient, cost effective and relatively inexpensive to manufacture, and easily maintained by a novice or inexperienced operator.

Briefly, the above and further objects of the present invention are realized by providing a new and improved paper shredder for mutilating paper of varying stacks of thickness, even bound together with staples and the like, in a highly efficient and effective manner, with little or no jamming of the shredder due to the presence of such staples and the like.

The new and improved paper shredder includes a base or housing member adapted to rest on a supporting surface in a stationary manner. A feeder chute or inlet is disposed on one side of the housing members for receiving manually inserted stacks or bundles of paper of uniform or varying degrees of thickness. A pair of low speed feed biased rollers are disposed in the feeder chute adjacent to its opening for engaging the paper frictionally and for moving the paper into a contoured throat which guides the paper into a set of primary wire bristles rotating at a very high speed. As the paper makes contact with the wire bristles, the bristles simultaneously pull the paper along the throat into a shredding chamber and shred the paper.

A stationary brush assembly is mounted within the shredding chamber and is disposed opposite the contoured throat. The stationary brush assembly includes a set of long wire bristles, which contact or mesh with the primary bristles. In this manner, as the primary bristles are rotated, they mesh with the bristles of the stationary brush assembly and thereby the shredded paper bits, staples, paper clips and other objects, that may have become lodged in the bristles of the primary bristles, are easily and conveniently dislodged within the shredding chamber. The dislodged debris is guided from the shredder via a discharge chute or outlet, which is disposed at one end of the shredding chamber.

BRIEF DESCRIPTION OF DRAWINGS

The above mentioned and other objects and features of this invention and the manner of attaining them will become apparent, and the invention itself will be best understood by reference to the following description of the embodiments of the invention in conjunction with the accompanying drawings, wherein:

FIG. 1 is a sectional partially broken away view of an apparatus for shredding paper, which apparatus is constructed in accordance with the present invention;

FIG. 2 is a partially broken away plan view of the apparatus of FIG. 1;

BEST MODE FOR CARRYING OUT THE INVENTION

Figure 3:
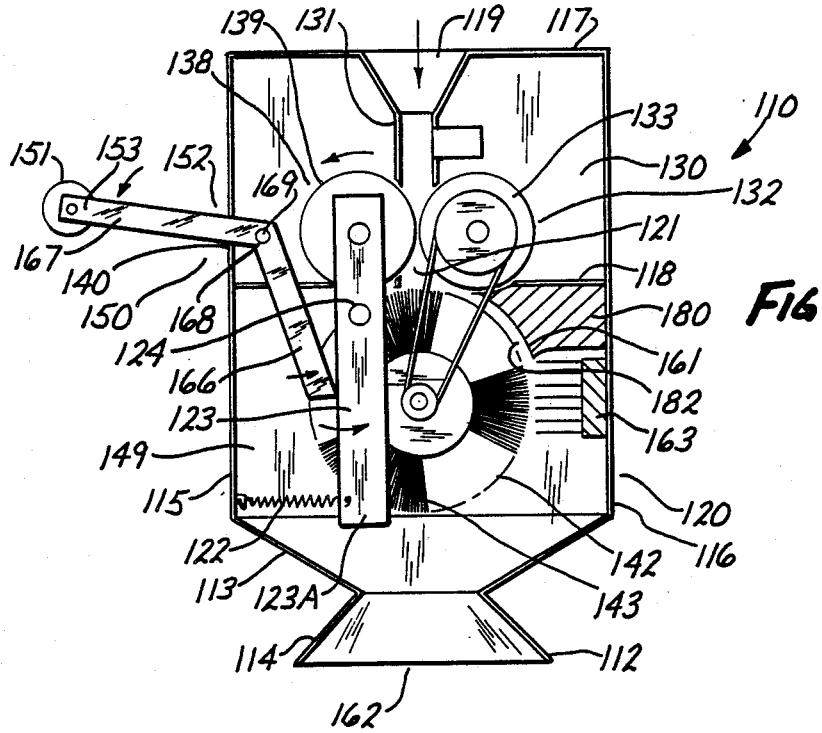
FIG. 3 is a side elevational sectional view of another apparatus for shredding paper, which is constructed in accordance with the present invention.

Referring now to the drawings, and more particularly to FIGS. 1, 2, and 3, there is shown a paper shredding apparatus 10 which is constructed in accordance with the present invention.

The apparatus 10 generally comprises a housing member 20 for supporting the apparatus 10 on any convenient stationary surface, such as a table (not shown). The housing member 20 is an enclosed structure and includes a base 12, a pair of end walls 13 and 14, sidewalls 15 and 16 and a top cover 17. The housing member 20 also includes an internal chamber wall 18 that divides the interior of the housing 20 into a passage chamber 30 and a shredding chamber 49.

An inlet 19 is disposed in the end wall 13 and defines an entranceway to a duct 31 defining a passageway through the passage chamber 30 for the flow of the paper material to be shredded. At the opposite end of the duct 31 is an outlet 21 for permitting the paper material to be guided out of the duct 31 into the shredding chamber 49.

A pair of biased roller assemblies 32 and 38 are centrally disposed in duct 31 adjacent to the outlet 21. The roller assemblies 32 and 38 include rollers 33 and 39 respectively that are biased together in mating engagement by a spring 22 so that the rotation of the first roller 33 drives the second roller 39. A motor 45 is mounted to the housing member 20 and drives the first roller assembly 32. In this manner, as one or more sheets of paper are manually fed into the duct 31 through the inlet 19, the rollers 33 and 39 frictionally engage the planar surfaces of the paper forcing the paper to traverse through the duct 31 and out of the outlet 21 into a first brush assembly 42 disposed in the shredding chamber 49.

The first brush assembly 42 is mounted on a shaft 46 journalled in a pair of bearings, such as bearing 48, mounted in sidewalls 15 and 16 respectively. One end of the shaft 46 is directly connected to the motor 45 for rotatively driving the shaft 46. The first brush assembly 42 includes a plurality of individual bristles, shown generally at 43, that are mounted to the shaft 46. The bristles 43 extend radially outwardly from the shaft 46 to form a partial cylindrical drum which extends between the end wall 14 and the chamber wall 18 of the housing member 20, but slightly out of contact with the same.

In operation as a sheet or stack of paper exits outlet 21, the bristles 43 of the first brush assembly 42 drive the paper upwardly against a contoured throat 80 that is mounted on top of duct 31 within the passage chamber 30. As best seen in FIG. 1, the contoured throat 80 extends upwardly from the top of duct 31 at a slightly inclined angle therefrom through an opening in the chamber wall 18 and terminating within the shredding chamber 49. As the first brush assembly 42 drives the paper upwardly against the throat 80, the contoured throat 80 temporarily guides the paper in mating engagement with the bristles 43 of the first brush assembly 42 as the paper is pulled and driven into the shredding chamber 49. As the paper travels along the surface 61 of the throat 80, the bristles 43 of the first brush assembly 42 shred the paper.

A second brush assembly 63 is also disposed within the shredding chamber 49 and is mounted to the end wall 14 of the housing member 20. The second brush assembly 63 includes a set of steel bristles, shown generally at 65, that intertwine or contact the bristles 43 of the first brush assembly 42 for removing the shredded paper from the bristles 43 and any other debris material, such as staples and paper clips that might have become lodged therein. A discharge chute 62 is provided in the base 12 of the housing member 20 so that as the paper and debris is removed from the bristles 43, it falls under the force of gravity into the discharge chute 62 and out of the housing member 20 into any conventional waste container (not shown).

Considering now the operation of the new and improved paper shredder 10 in greater detail, in operation, a stack of paper (or an individual sheet of paper) is guided into the duct 31 via the inlet 19 (FIG. 1). As the paper (not shown) is guided into the duct 31 the leading edges of the paper are frictionally gripped by rollers 33 and 39 and pulled traversely through duct 31 and out through outlet 21 into the shredding chamber 49. As the paper is pulled into the shredding chamber 49 it comes into shredding contact with the bristles 43 of the first brush assembly 42 and is driven upwardly by the rotating bristles 43 and against the surface wall 61 of the contoured throat 80. As the paper is driven against the throat wall 61, the throat 80 guides the paper into the shredding chamber 49 and is simultaneously shredded. By reason of the shredding action, shredded paper and other debris may become embedded within the bristles 43. As the bristles 43 continue in their path of rotation, they come into meshing contact with the bristles 65 of the second brush assembly 63. This meshing action causes the debris and paper material embedded within the bristles 43 to be dislodged and removed so that the debris falls under the force of gravity into the lower portion of the shredding chamber 49 and out the discharge chute 62 into a conventional waste container (not shown).

Considering now the duct 31 in greater detail with reference to FIG. 1, the duct 31 is generally an integrally formed smooth hollow rectangular conduit of uniform cross sectional thickness. The duct 31 has a pair of openings 26 and 29 adjacent the opening 21 that are adapted to receive a portion of the rollers 33 and 39, respectively. The duct 31 is mounted, by a conventional mounting technique between the chamber wall 18 and the end wall 13 of the housing member 20.

Considering now the roller assembly 32 in greater detail with reference to FIGS. 1 and 3, the roller assembly 32 includes a shaft 34 that is journalled in a set of bearings, such as bearing 35, mounted in side walls 15 and 16, respectively. The shaft 34 is disposed within the passage chamber 30 having one of its terminal ends extending through the sidewall 16. A pulley 36 is mounted on the shaft 34 near its terminal end that extends beyond the side wall 16. The pulley 36 is adapted to receive a drive belt 37 that loops between pulley 36 and a pulley 47 attached to the shaft 46. In this manner, as the motor 45 drives shaft 46, the driving force of the motor 45 will be transmitted to the shaft 34.

As best illustrated in FIGS. 1 and 2, the pulley 47 is substantially smaller than pulley 36, thereby causing shaft 34 to rotate at a substantially lesser speed than shaft 47. In the preferred embodiment, a ratio of 1:2.5 is established between the pulleys 47 and 36.

The roller assembly 32 also includes the roller 33 that is composed of a relatively hard rubber material. The roller 33 is generally cylindrical shaped and is fastened removably to the shaft 34 by means of bolt and nut (not shown). Roller 33 has a circumference that is dimensioned such that its outer peripheral surface is in a tangential orientation to the lower wall 28 of the duct 31.

Considering now the roller assembly 38 in greater detail with reference to FIG. 1, the roller assembly 38 generally includes an elongated lever arm 23 that extends longitudinally substantially throughout the entire axial length of the passage chamber 30. The lever arm 23 is mounted in a cantilevered manner by a shaft 24 that extends between the sidewalls 15 and 16 respectively of the housing 20. A hole 24A is disposed in the arm 23 nearer to one of its ends than the other and is adapted to receive a bushing (not shown). The shaft 24 is received within the bushing so the arm 23 may freely pivot about the shaft 24.

As best seen in FIG. 1, the roller assembly 38 also includes a second shaft 25 that is fixed transversely to arm 23 and adjacent its terminal end that is more closely disposed to the shaft 24. Shaft 25 is adapted to receive the roller 39 that is substantially identical to roller 33. The spaced apart distance between the arm mounting shaft 24 and roller shaft 25 is dimensioned so that shaft 25 is positioned over the duct opening 29 and directly opposite and perpendicular to shaft 34. With this mounting arrangement, roller 39 comes into mating engagement with roller 33. It should be understood that shaft 34 is mounted in a fixed position thereby fixing the location of roller 33 within duct 31. Shaft 25 however is mounted to arm 23 that pivotally moves about shaft 24 so that roller 39 may move up and down in a perpendicular plane relative to roller 33 thereby permitting a single sheet of paper or a stack of paper (having a height that is slightly less than the height of the duct 31) to be frictionally engaged between rollers 33 and 39 within the duct 31. It should also be understood because of the upward and downward travel of roller 39 into duct 31 that opening 29 is substantially larger than opening 26 within the duct 31.

For the purpose of biasing the rollers 33 and 39 together, the opposite end of the lever arm 23 from roller 39 is biased upwardly by the spring 22. Spring 22 is attached between the bottom 12 of the housing member 20 and the end portion 23A of arm 23. The spring 22 forces the end portion 23A of the arm 23 upwardly thereby pivoting the opposite end of the arm 23 downwardly about shaft 24 so that roller 39 is forced into mating engagement with roller 33. The force exerted by spring 22 is sufficient to cause roller 33 and 39 to frictionally engage one another but is not so great as to prevent a single sheet of paper from being frictionally gripped between the rollers 33 and 39 and pulled traversely through duct 31.

Also as best seen in FIG. 1, for emergency release purposes to spread the rollers manually, a handle assembly 50 is also disposed on the end portion 23A of the arm 23. The handle assembly 50 includes a mounting bar 52 that projects perpendicularly upwardly from arm 23 through an opening 40 that is disposed in the top cover 17 of the housing 20. A U-shaped yoke 53 is disposed on the terminal end of the mounting 52. The yoke 53 is generally a U-shaped body section of uniform cross sectional thickness having a base section (not shown) and a pair of equally spaced sidewalls 55 and 56 projecting generally upwardly and perpendicularly from the base 54 terminating in a rim 57. Each side wall 55 and 56 has a hole, such as hole 58, that are disposed adjacent the rim 57. The distance between the opposing inner surfaces of side walls 55 and 56 is dimensioned to receive a handle 51.

Considering now the handle 51 in greater detail with reference to FIGS. 1 and 2, the handle 51 is composed of a hard rubber material and is generally a body section of uniform cross sectional thickness that is cylindrical in plane view. Each respective longitudinal end of the handle has a mounting stud such as mounting stud 54.

Considering now the first brush assembly 42 in greater detail with reference to FIGS. 1 and 2, the firs brush assembly 42 is generally a horizontal cylindrical brush configuration that includes the radial bristles, generally shown at 43. The brush assembly 42 also includes the shaft 46 that is driven by the motor 45 so the bristles 43 may rotate on the shaft 46 at a high rate of speed.

Considering now the contoured throat 80 in greater detail with reference to FIGS. 1 and 2, the throat 80 is generally a parallelogram shaped elongated plate having a cut out portion defining a concave surface 61 along its horizontal axis. The radial curvature of the throat surface 61 is dimensioned to coincide with the radial curvature of the cylindrical brush assembly 42 to define a gap or channel 82 between the throat surface 61 and the tips of the bristles 43. The throat 80 is mounted in a track (not shown) disposed on the top surface 44 of duct 31 so the throat 80 may be adjusted forwardly and backwardly relative to the tips of the radial bristles 43. The throat 80 is spring biased by a spring 83 to be urged resiliently toward the bristles 43. In this manner, the gap 82 between the bristles 43 and the concave surface 61 of the throat 80 may be varied.

As shown in FIG. 3, there is illustrated another shredder 110 constructed in accordance with the present invention. In this construction, the shredder 110 generally comprises a housing member 120 for mounting the apparatus 110 on any convenient stationary surface. The housing member 120 is an enclosed structure that includes a base member 112, four sidewalls, such as sidewalls 115 and 116, and a top cover 117. The housing member 120 also includes an internal chamber wall 118 that divides the interior of the housing 120 into a passage chamber 130 and a shredding chamber 149.

An inlet 119 is disposed in the cover 117 and defines an entranceway to a duct 131 defining a passageway through the passage chamber 130 for the flow of the paper material to be shredded. At the opposite end of the duct 131 is an outlet 121 for permitting the paper material to be guided out of the duct 131 into the shredding chamber 149.

A pair of roller assemblies 132 and 138 are centrally disposed in the duct 131 and are substantially similar to roller assemblies 32 and 38 except as hereinafter described in greater detail.

Considering now the roller assembly 138 in greater detail with reference to FIG. 3, the roller assembly 138 generally includes an elongated lever arm 123 that extends vertically substantially through the entire axial height of the passage chamber 130. The lever arm 123 is mounted in a cantilevered manner by a shaft 124 that extends between a pair of the housing sidewalls.

Each roller assembly 132 and 138 includes a driving roller 133 and 139 respectively. For the purpose of biasing rollers 133 and 139 together a spring 122 is attached to the lower end 123A of the lever arm 123 and extends between the lever arm 123 and side wall 115. The spring 122 biases the rollers 133 and 139 together in a manner similar to spring 22.

As best seen in FIG. 3, shredder 110 also includes a handle assembly 150. Handle assembly 150 includes a generally L-shaped mounting bat 152 of unitary construction having two leg portions 166 and 167 respectively. Leg portion 166 is attached by a conventional mounting technique to arm 123 and extends upwardly therefrom at a slightly inclined angle toward the chamber wall 118. Leg 166 integrally terminates in leg portion 167 that projects traversely at a slightly inclined angle relative to the arm 123 through an opening 140 disposed in sidewall 115 of the housing member 120.

A hole 168 is centrally disposed in the mounting bar 152 at the junction between leg portion 166 and 167. A bushing (not shown) is received within the hole 168 and is adapted to receive a shaft 169 . A U-shaped yoke 153 is disposed on the terminal end of the leg portion 167 of the mounting bar 152. The yoke 153 is substantially identical to yoke 53. The handle assembly 150 also includes a handle portion 151.

Considering now the second brush assembly 163 in greater detail, the second brush assembly 163 is substantially identical to brush assembly 63 except that it is mounted on side wall 116 and is disposed directly beneath a contoured throat 180.

Considering now the contoured throat 180 in greater detail, the throat 180 is also generally identical to throat 80 except that it is mounted to side wall 116 directly above the second brush assembly 163. The radial curvature of the throat surface 161 is dimensioned to coincide with the radial curvature of the cylindrical brush assembly 142 to define a gap 182 between the throat surface 161 and the tips of the bristles 143.

Considering now the base member 112 in greater detail with reference to FIG. 3, the base member 112 is of a generally hour glass shape and includes an upper portion 113 and a lower portion 114. The lower portion 114 has an opening 162 that is centrally disposed directly beneath the first brush assembly 142. In this manner, as the paper debris is dislodged from the bristles 143 of the brush assembly 142 the debris falls under the force of gravity and out of the shredding chamber 149 through opening 162.

Figure 4:
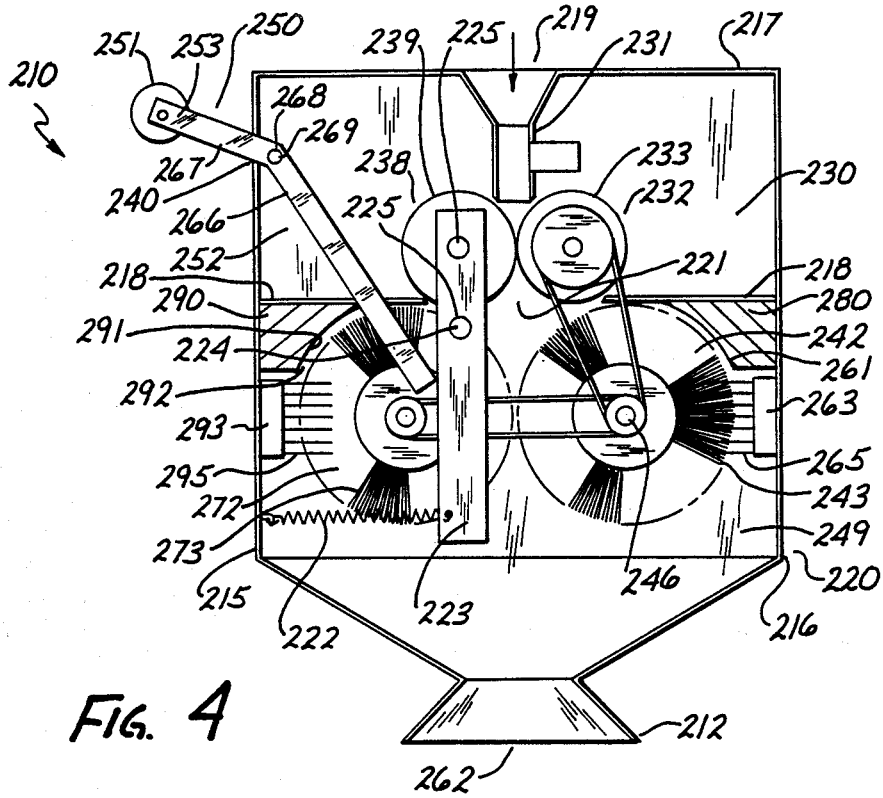
FIG. 4 is a side elevational sectional view of yet another apparatus for shredding paper, which is also constructed in accordance with the present invention.

As shown in FIG. 4, there is illustrated yet another shredder 210 constructed in accordance with the present invention.

The shredder 210 generally comprises an enclosed housing member 220 for supporting the shredder 210 on a convenient surface. The housing member 220 is an enclosed structure and includes a base 212, a set of side walls, such as walls 215 and 216, and a top cover 217. The housing member 220 also includes an internal chamber wall 218 that divides the interior of the housing into a passage chamber 230 and a shredding chamber 249.

An inlet 219 is disposed in the top cover 217 and defines an entranceway to a duct 231 defining a passageway through the passage chamber 230 for the flow of paper material to be shredded. At the opposite end of the duct 231 is an outlet 221 for permitting the paper material to be guided out of the duct 231 and into the shredding chamber 249.

A pair of biased roller assemblies 232 and 238 are centrally disposed in the duct 231 adjacent the outlet 221. The roller assemblies 232 and 238 include rollers 233 and 239 respectfully that are biased together in mating engagement by a spring 222, that is similar to spring 22, so that the rotation of the first roller 233 drives a second roller 239. A motor (not shown) is mounted to the housing member 220 and drives the first roller assembly 232. In this manner, as one or more sheets of paper are manually fed into the duct 231 through the inlet 219, the rollers 233 and 239 frictionally engage the planar surfaces of the paper forcing the paper to traverse through the duct 231 and out of the outlet 221 into a pair of brush assembly 242 and 273 disposed within the shredding chamber 249.

Brush assemblies 242 and 272 are substantially identical to brush assembly 42 except they rotate in opposite directions. Brush assembly 242 and 272 are substantially identical to one another so only brush assembly 242 will now be described in greater detail.

The first brush assembly 242 is mounted on a shaft 246 journalled in a pair of bush bearings (not shown) mounted in the side walls of the housing. One end of the shaft 246 is directly connected to he motor for rotatively driving the shaft 246. The first brush assembly 242 includes a plurality of individual bristles, shown generally at 243, that are mounted to the shaft 246. The bristles 243 extend radially outwardly from the shaft 246 to form a partial cylindrical drum which extends between the chamber wall 218 and the base portion 212 of the housing member 220, but slightly out of contact with the chamber wall 218.

In operation as a sheet or stack of paper exits outlet 221, the bristles 243 of the first brush assembly 242 and the bristles 273 of the second brush assembly 272 divide and drive the paper sidewardly against a pair of contoured throat 280 and 290 that are mounted to side wall 215 and 216, respectively, within the shredding chamber 249.

The operation of the two brush assemblies 242 and 272 are substantially identical so only assembly 242 will now be described in greater detail. As best seen in FIG. 4, the contoured throat 280 projects perpendicularly from the side wall 216 terminating adjacent the tips of the bristles 243 of the first brush assembly 242. As the first brush assembly 242 drives the paper sidewardly against the throat 280, the contoured throat 280 positions the paper in mating engagement with the bristles 243 of the first brush assembly 242 as the paper is pulled and driven into the shredding chamber 249. As the paper travels along the surface 261 of the throat 260, the bristles 243 of the first brush assembly 243 shred the paper.

A second brush assembly 263 is also disposed within the shredding chamber 249 and is mounted directly below assembly 243 to the side wall 216 of the housing member 220. The second brush assembly 263 includes a set of steel bristles, shown generally at 265, that intertwine or contact the bristles 243 of the first brush assembly 242 for removing the shredded paper from the bristles 243 and any other debris material, such as staples and paper clips that might have become lodged therein. A discharge opening 262 is provided in the base 212 of the housing member 220 so that as paper and debris is removed from the bristles 243, it falls under the force of gravity into the discharge opening 262 and out of the housing member 220 into any conventional waste container (not shown).

Considering now the roller assembly 238 in greater detail with reference to FIG. 4, the roller assembly 238 generally includes an elongated lever arm 223 that extends longitudinally substantially throughout the entire axial height of the shredding chamber 249 and partially into the passage chamber 230. The lever arm 223 is mounted in a cantilever manner by a shaft 224 that extends between the lever arm and one of the side walls of the housing member 220. A hole 225 is disposed in the arm 223 near one of its ends and the other end, and is adapted to receive a bushing (not shown). The shaft 224 is received within the bushing so that the arm 223 may freely pivot about the shaft 224.

As best seen in FIG. 4, the roller assembly also includes a second shaft 225 that is fixed traversely to the arm 223 and adjacent its terminal end that is more closely disposed to the shaft 224. Shaft 225 is adapted to receive the roller 239 that is substantially identical to roller 39. The spaced apart distance between the arm mounting shaft 224 and the roller shaft 225 is dimensioned so that the shaft 225 is positioned over an opening 229 in the duct 231 and directly opposite and perpendicular to shaft 234. With this mounting arrangement, roller 239 comes into mating engagement with roller 233. It should be understood that the shaft 234 is mounted in a fixed position thereby fixing the location of roller 233 within duct 231. Shaft 225 however is mounted on arm 223 particularly moves about shaft 224 so that roller 239 may move back and forth in horizontal plane relative to roller 233. This lateral movement permits the rollers 233 and 239 to separate thereby permitting a single sheet of paper or a stack of paper (having a height that is slightly less than the height of the duct 231) to be frictionally engaged between the rollers 233 and 239 within the duct 231. It should also be understood because of the traverse travel of the roller 239 into duct 231 that opening 229 is substantially larger than opening 226 within the duct 231.

The opposite end of the levered arm 223 from the roller 239 is biased sidewardly by the spring 222. Spring 222 is attached between the side wall 215 of the housing member and the arm 223. The spring 222 forces the arm 223 sidewardly thereby pivoting the opposite end of the arm sidewardly about the shaft 224 so that roller 239 is forced into mating engagement with roller 233. The force exerted by the spring 222 is sufficient to cause rollers 233 and 239 to frictionally engage one another but no so great as to prevent a single sheet of paper from being frictionally gripped between the rollers 233 and 239 and pulled downwardly through duct 231. Also as shown in FIG. 3, a handle assembly 250 is also disposed on the opposite end of the arm 223. The handle assembly includes a generally L-shaped mounting bar 252 of unitary construction having two leg portions 266 and 267, respectively. Leg portion 266 appeared by conventional mounting technique to arm 223 and extends upwardly therefrom at a slightly inclined angle towards the chamber wall 218. Leg 266 integrally terminates in leg portion 267 that projects traversely at a slightly inclined angle relative to the arm 223 through an opening 240 disposed in the side wall 213 of the housing member 220.

A hole 268 is centrally disposed in the mounting bar 252 at the junction between leg portions 266 and 267. Hole 268 is adapted to receive a shaft 269 having a bushing (not shown) mounted within the hole 268. A U-shaped yolk 253 is disposed on the terminal end of leg portion 267 of the mounting bar 252. The yolk 253 is substantially identical to yolk 53. The handle assembly 250 also includes a handle portion 251.

In operation, as a user, for example pushes downwardly on handle 251 on the direction of the arrow shown in FIG. 3 the lever arm 223 is forced inwardly away from side wall 213 thereby causing roller 239 to move away from roller 233.

Considering now the contoured throat 280 in greater detail with reference to FIG. 3, the throat 280 is generally a rectangular shaped elongated plate having a cut out portion defining a concave surface 281 along its axis perpendicular to chamber wall 218. The radial curvature of the throat surface 261 is dimensioned to coincide with the radial curvature of the cylindrical brush assembly 242 to define a gap 282 between the throat surface 281 and the tips of the bristles 243. A similar gap 292 is formed between the tips of bristles 273 and the surface 291 of the second contoured throat 290.

Although not described in detail, it should be understood that a second stationary brush assembly 293 is provided within shredding chamber 249 and that is substantially identical to assembly 263. Brush assembly 293 is mounted on side wall 215 and includes a set of stiff bristles shown at 295.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A paper shredder comprising:

housing means having enclosed sides with an inlet therein for permitting the entrance of at least one sheet of paper and an outlet therein for permitting the discharge of shredded paper fragments;

pathway means for defining a given pathway of travel to permit the passage of said paper in a given path traversing from said inlet to said outlet;

means for shredding said paper as it traverses from said inlet to said outlet, said shredding means including a plurality of bristles whose tip portions form a cylindrical surface;

said pathway means including means defining a drive pathway extending along a section of said given pathway of travel;

means for moving said paper along said drive pathway and into intersecting engagement with the bristles of said shredding means;

elongated arcuate plate means having an arcuate surface throughout its length, said length being substantially coextensive with the longitudinal length of said shredding means;

means for mounting said arcuate plate means in a parallel spaced-apart confronting relationship relative to a given sector of the cylindrical surface formed by said tip portions of said shredding means;

means including said sector of the cylindrical surface formed by the rotating bristle tip portions and the arcuate surface of said plate means for defining an arcuate shredding pathway, said given pathway of travel including said arcuate shredding pathway; and means driving rotatably said shredding means for moving the paper being shredded into and along substantially the entire arcuate shredding pathway so the plane surface of the paper being shredded comes into shredding engagement with said means for shredding over and along substantially the entire arcuate shredding pathway.

2. The apparatus of claim 1, further comprising:

means for removing said paper when shredded from said shredding means.

3. The apparatus as recited in claim 2, wherein the means for removing said shredded paper from said shredding means comprises a stationary brush assembly being adjustably mounted to said housing means to affect adjustment of said stationary brush assembly relative to said means for shredding paper.

4. The apparatus as recited in claim 3, wherein the stationary brush assembly has a plurality of bristles.

5. The apparatus as recited in claim 4, wherein the bristles of the stationary brush assembly are composed of a rigid material 6. The apparatus as recited in claim 5, wherein the rigid material is steel wire.

7. The apparatus as recited in claim 1, wherein said means for moving the paper comprises:

a first roller assembly mounted on a first shaft, journalled in the sides of said housing means;

motor means mounted on said housing and coupled to said first shaft for rotating said first roller assembly;

a second roller assembly mounted on a second shaft journalled in a cantilever beam pivotally mounted to said housing means; and means interposed between said housing means and said cantilever beam for biasing said first roller assembly and said second roller assembly together in mating engagement so that the rotation of the first roller assembly drives the second roller assembly, whereby when said paper is fed manually into said inlet, said paper is forced frictionally between said first and second roller assemblies and along said drive path and into intersecting engagement with said shredding means.

8. The apparatus of claim 7, further comprising:

means mounted to said cantilever beam for pivoting said beam thereby separating said first roller assembly and said second roller assembly from mating engagement.

9. The apparatus as recited in claim 7, wherein said means for shredding said paper comprises:

a first brush assembly mounted on a third shaft journalled in the sides of the housing means, said third shaft being coupled to said first roller assembly so that said first brush assembly is driven by said first roller assembly; and said first brush assembly having a plurality of bristles forming a cylindrical surface and being mounted to substantially position said cylindrical surface below said plate means, whereby rotation of the first brush assembly drives the bristles thereof into said paper and in contacting relationship with said plate means for shredding said paper.

10. The apparatus as recited in claim 9, wherein the bristles of said first brush assembly is composed of a rigid material.

11. The apparatus as recited in claim 10, wherein said bristles are composed of steel wire.

12. The apparatus as recited in claim 9, wherein said plate means is mounted adjustably to said housing means to effect adjustment of said plate relative to said first brush assembly 13. The apparatus as recited in claim 9, wherein said plate means for shredding said paper further comprises:

a second brush assembly mounted on a shaft journalled in the side of said housing means;

said second brush assembly being coupled to said first brush assembly so that said second brush assembly is rotatably driven by said first brush assembly in a rotatable direction opposite to said first brush assembly;

said second brush assembly having a plurality of bristles forming a cylindrical surface and being mounted in a parallel spaced apart confronting relative relation to the cylindrical surface of said first brush assembly so that said cylindrical surfaces approximate a contacting relationship with one another at one give segment of said drive path.

14. The apparatus as recited in claim 13, wherein said drive pathway extends tangentially into said shredding means.

15. The apparatus as recited in claim 13, wherein the bristles of said second brush assembly are composed of a rigid material.

16. The apparatus as recited in claim 15, wherein the rigid material is steel wire.

17. The apparatus as recited in claim 1, wherein said drive pathway extends axially into said shredding means.

18. A method of shredding paper or the like, comprising:

using housing means having an inlet and an outlet;

driving at least one sheet of paper along a given pathway of travel for permitting the passage of said paper from said inlet to said outlet;

moving drivingly said paper along a drive pathway, and into intersecting shredding engagement with a set of rotating shredding bristles whose tip portions form a cylindrical surface, said drive pathway forming a part of said given pathway of travel;

using an arcuate plate, having an arcuate surface throughout its length, said arcuate plate being mounted in a parallel spaced-apart confronting relationship relative to a given sector of the cylindrical surface formed by the tip portions of said bristles to define an arcuate shredding pathway;

deflecting drivingly the paper being shredded away from said drive pathway and into the arcuate shredding pathway, said arcuate shredding pathway forming part of said pathway of travel and including said sector of the cylindrical surface formed by the rotating bristle tip portions and the arcuate surface of said arcuate plate; and driving shreddingly the paper being shredded along substantially the entire arcuate shredding pathway so the plane surface of the paper being shredded comes into shredding engagement with the tip portions of said set of bristles.

* * * * *

UNITED STATES PATENT AND TRADEMARK OFFICE

CERTIFICATE OF CORRECTION

PATENT NO. : 4,903,900

DATED : February 27, 1990

INVENTOR(S) : David Rousseau

It is certified that error appears in the above-identified patent and that said Letters Patent is hereby corrected as shown below:

Column 6, line 2, before "brush", delete "firs", and substitute therefor --first--.

Column 8, line 9, before "motor", delete "he", and substitute therefor --the--.

Column 9, line 33, before "so great", delete "no", and substitute therefor --not--.

Column 11, line 3, after "material", insert --.--.

Column 11, line 53, after "assembly", insert --.--.

Column 11, line 55, after "said" and before "means" in line 55, delete "plate".

Signed and Sealed this

Twenty-eighth Day of May, 1991

*Attest:*

HARRY F. MANBECK, JR.

*Attesting Officer*

*Commissioner of Patents and Trademarks*